US007561018B2

(12) United States Patent
Buettner

(10) Patent No.: US 7,561,018 B2
(45) Date of Patent: Jul. 14, 2009

(54) FUSE STRIP WITH LATERAL OUTGOING CONTACTS AND A LATERAL ADAPTER MODULE

(75) Inventor: Alex Buettner, Röedental (DE)

(73) Assignee: Wöhner GmbH & Co. KG, Roedental (DE)

( * ) Notice: Subject to any disclaimer, the term of this patent is extended or adjusted under 35 U.S.C. 154(b) by 147 days.

(21) Appl. No.: 11/672,811

(22) Filed: Feb. 8, 2007

(65) Prior Publication Data

US 2007/0188291 A1 Aug. 16, 2007

(30) Foreign Application Priority Data

Feb. 9, 2006 (DE) ..... 10 2006 006 050
Feb. 9, 2006 (DE) ..... 10 2006 006 051

(51) Int. Cl.
*H01H 85/02* (2006.01)
*H01H 85/36* (2006.01)

(52) U.S. Cl. ..... 337/189; 337/186; 337/187; 361/626; 361/630; 361/642

(58) Field of Classification Search ..... 337/189, 337/190, 186, 187; 361/626, 630, 642, 633, 361/636, 643
See application file for complete search history.

(56) References Cited

U.S. PATENT DOCUMENTS

| | | | | |
|---|---|---|---|---|
| 2,030,506 | A * | 2/1936 | Driescher | 337/284 |
| 5,515,023 | A | 5/1996 | Marach et al. | |
| 6,531,948 | B1 * | 3/2003 | Mennell | 337/211 |
| 6,759,939 | B2 * | 7/2004 | Sudan et al. | 337/211 |
| 6,794,979 | B2 * | 9/2004 | Sudan et al. | 337/211 |
| 7,355,503 | B2 * | 4/2008 | Buettner | 337/211 |
| 2006/0243569 | A1 | 11/2006 | Buettner | |

FOREIGN PATENT DOCUMENTS

| | | | |
|---|---|---|---|
| DE | 2547379 | A * | 8/1976 |
| DE | 7929920 | | 10/1979 |
| DE | 3316203 | | 11/1984 |
| DE | 8804560 | | 7/1988 |

(Continued)

OTHER PUBLICATIONS

English Language Abstract of DE 4329428.

(Continued)

*Primary Examiner*—Anatoly Vortman
(74) *Attorney, Agent, or Firm*—Greenblum & Bernstein, P.L.C.

(57) ABSTRACT

The invention relates to a fuse strip, comprising a housing, preferably made of plastics material, with at least two means, arranged in the housing, for receiving fuse elements, with clamping feet provided on the underside of the housing, wherein a contact for contacting the associated conductor rail is configured in the region of each clamping foot. Laterally of the housing, in the region of each clamping foot, there is provided a laterally integrally formed terminal block which receives a respective outgoing contact for connecting an outgoing line. In a preferred embodiment, each terminal block contains a guide for receiving a contact pin of an adapter strip in such a way that when the adapter strip is attached, each contact spring is electrically connected to the associated outgoing contact of each terminal block and wherein the adapter strip is provided with an end-face module comprising terminal clamps.

12 Claims, 9 Drawing Sheets

FOREIGN PATENT DOCUMENTS

| | | |
|---|---|---|
| DE | 9310753 | 9/1993 |
| DE | 4329428 | 1/1995 |
| DE | 29512870 | 12/1995 |
| DE | 29512870 | 2/1996 |
| DE | 29608176 | 9/1996 |
| DE | 19610958 | 9/1997 |
| DE | 10054168 | 6/2002 |
| DE | 10062634 | 6/2002 |
| DE | 10104516 | 8/2002 |
| DE | 10115777 | 5/2003 |
| EP | 1585156 | 10/2005 |
| WO | 2004/073127 | 8/2004 |

OTHER PUBLICATIONS

English Language Abstract of DE 19610958.
English Language Abstract of DE 10115777.
English Language Abstract of DE 10054168.
English Language Abstract of DE 3316203.
English Language Abstract of EP 0806812.
English Language Abstract of 10062634.
English Language Abstract of EP 1585156.

* cited by examiner

FUSE STRIP WITH LATERAL OUTGOING CONTACTS AND A LATERAL ADAPTER MODULE

BACKGROUND OF THE INVENTION

The invention relates to a fuse strip.

A fuse strip is known, for example, from DE 100 54 168. Fuse strips of this type are preferably of two or three-pole configuration and are clamped on a group consisting of two or three conductor rails. Fuse strips of this type contain, for each conductor, a fuse unit located between the respective conductor of the conductor rail group and a subsequent device in the circuit. Fuse strips of this type are conventionally provided with terminal clamps which are preferably configured in an end-face region of the strip and are used for connecting wires to the respective switching device. Fuse strips of this type have, in the region of a clamping foot, a contact element which contacts the associated conductor rail. This contact element is connected via conductors to one side of the associated fuse element, whereas the other side of the fuse element is electrically connected to a terminal screw to which a conductor of the respective switching device or the like can be connected.

SUMMARY OF THE INVENTION

The object of the invention is to configure a fuse strip of the type mentioned at the outset in such a way that the outgoing contacts allow direct and preferably screwless connection of outgoing lines.

Also to be provided is a fuse strip which can optionally be provided with end-face terminal clamps.

The invention provides a fuse strip, in particular a bridged fuse strip for direct attachment to a conductor rail system, wherein the outgoing contacts are configured, in each case, laterally of the fuse strip. This allows direct connection of outgoing lines to the lateral outgoing contacts. A basic advantage of the fuse strip according to the invention is that the conductor tracks, conventionally necessary within the housing in the case of known fuse strips, leading to the end-face terminal clamps are dispensed with, i.e. the fuse strip as a whole can have a more pleasant and shorter shape and the complex arrangement, extending in the longitudinal direction of the strip and necessitated by the insulating ribs, for insulating the adjacent conductor guides is dispensed with.

According to a preferred embodiment, the lateral outgoing contacts are equipped with clamping springs, thus allowing screwless connection of the outgoing lines, i.e. for connection to the fuse strip, the outgoing lines have merely to be inserted into the respective openings and are automatically engaged. For detaching the outgoing lines, there is provided an additional opening through which the engagement between the outgoing contact and outgoing line can be cancelled using a tool.

According to the present invention, all of the operationally relevant parts of a pole, i.e. the fuse socket, the incoming and outgoing contacts and each outgoing clamp, preferably in the form of a screwless spring clamp, are accommodated in each pole portion, i.e. within the fuse strip in the region of each terminal block 10 or 11 or 12 respectively. Each of these pole portions therefore forms a partial region in the form of an operative unit. The fuse strips can thus be configured as two-pole and, in a combination of two fuse strips of this type, four-pole embodiments.

In the fuse strip according to the invention, there are configured, for each outgoing contact, terminal blocks which are provided laterally of the strip and contain the outgoing contacts in an easily accessible manner. In a preferred embodiment, the laterally integrally formed terminal blocks contain, for each terminal contact, openings which extend vertically, i.e. perpendicularly to the longitudinal axis, for the introduction of the outgoing lines and, in each case, preferably an opening, also oriented vertically, for the introduction of a tool, for example a screwdriver, for cancelling the connection between the outgoing contact and outgoing line.

The fuse strip can be of two-pole but also multipolar configuration.

The invention further provides a fuse strip having lateral outgoing contacts which can, if required, be modified using an adapter strip so as to provide end-face terminal clamps.

In one embodiment, the fuse strip has, for each pole, laterally of the housing, a respective terminal block, an outgoing contact for the preferably screwless connection of outgoing lines being contained in each terminal block and each outgoing contact forming, via the respective fuse element, a circuit to the associated contact element for contacting each conductor rail.

In a further embodiment, each terminal block contains a guide for the introduction of outgoing lines.

In addition, each terminal block can have a further, preferably slotted, opening for the introduction of a tool toward the outgoing contact for clearing an outgoing line.

The guides are preferably configured substantially perpendicularly to the longitudinal axis of the fuse strip. Each outgoing contact preferably contains a contact and a clamping spring, the clamping spring having a spring tongue which is biased relative to a contact portion of the contact. Each contact can, in this case, be provided with an extended contact portion on which there is formed a portion which points away from the contact and has a contact tongue for receiving the clamping spring, the clamping spring being provided laterally offset to the contact.

The clamping spring is preferably a part separate from the contact and has an arm comprising a slot in such a way that a contact spring tongue of the clamping spring is arranged adjustably within the slot and the slot receives the contact spring of the contact. Each contact preferably includes two contact tongues located approximately parallel and mirror-symmetrically to each other, the two contact tongues being enclosed by a substantially U-shaped spring clamp.

The housing advantageously has a housing lower part containing recesses for receiving the contacts.

In a further embodiment, the fuse strip is of two-pole configuration and has, at least on an end face, connection means for receiving a further fuse strip.

The slots are advantageously provided parallel to the guides and are substantially aligned with a V-shaped arm portion of each contact tongue.

In order to explain further features, a preferred embodiment will be described hereinafter with reference to the drawings, in which:

DESCRIPTION OF THE PREFERRED EMBODIMENTS

Figure 1:
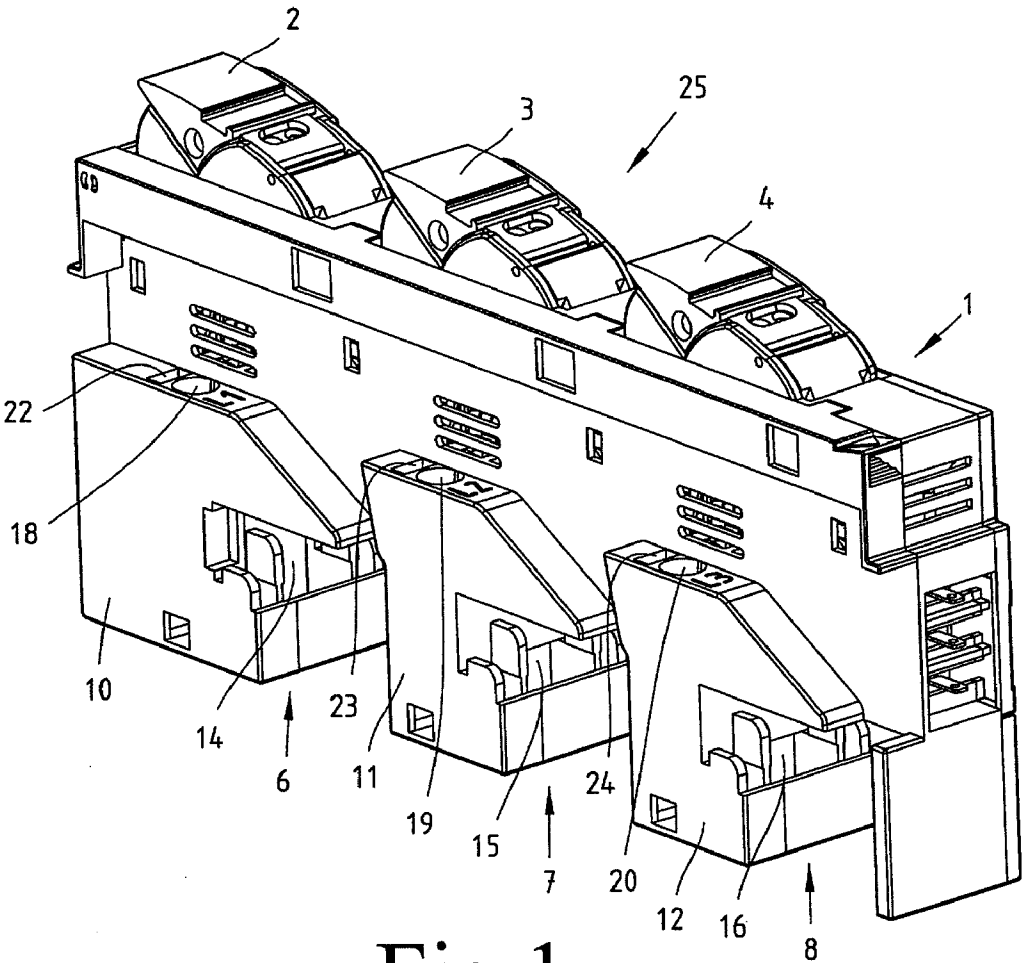
FIG. 1 is a perspective view of the fuse strip according to the invention from the side with the terminal blocks.

FIG. 1 shows a three-pole fuse strip consisting of a housing 1, preferably made of plastics material. The housing can be broken down into a housing upper part and a housing lower part, although this is not shown in detail in FIG. 1. In the case of the three-pole fuse strip shown in FIG. 1, the housing 1 contains three levers 2, 3, 4, the actuation of which causes fuse sockets, rotatably mounted within the housing, to be adjusted in such a way that the fuses provided in the fuse sockets can be removed or inserted. On the underside of the fuse strip there is, in each case, a clamping foot 6, 7, 8 which is placed onto a respective conductor rail (not shown). This principle is known per se.

Provided laterally of the fuse strip are terminal blocks 10, 11, 12 which receive each clamping foot 6, 7, 8 in a partially integrated manner, the terminal blocks 10, 11, 12 being set apart or separated from one another in the longitudinal direction of the fuse strip. Each terminal block 10, 11, 12 has a recess 14, 15, 16 allowing the respective clamping foot region arranged therein to be displaced via each conductor rail.

Each terminal block 10, 11, 12 contains at least one, preferably cylindrical, opening or guide 18, 19, 20 allowing an outgoing line to be displaced, preferably vertically downward, and inserted into a contact arrangement to be described hereinafter. In addition to the opening or guide 18, 19, 20, there is, for each terminal block 10, 11, 12, a respective further, preferably slotted, opening or guide 22, 23, 24 allowing a connection, once produced, between the contact arrangement and the outgoing line to be cancelled, if required, using a tool.

Figure 2:
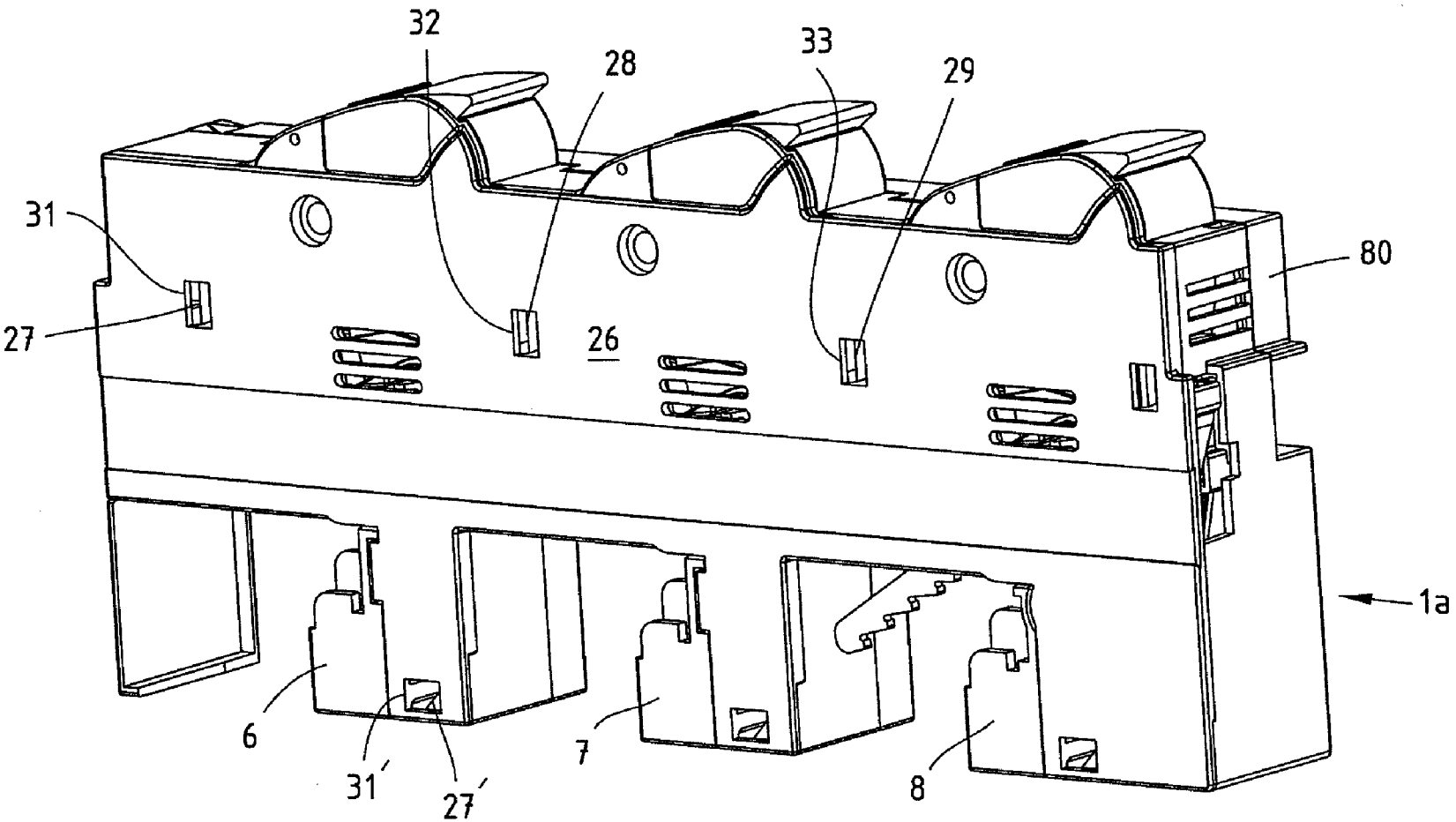
FIG. 2 is a view of the fuse strip according to FIG. 1, the fuse strip having been rotated through 180° compared to FIG. 1.

FIG. 2 is a view of the fuse strip corresponding to FIG. 1, from the direction of the arrow denoted by reference numeral 25 in FIG. 1, and shows the clamping feet 6, 7, 8 and a closure plate 26 which is fixed to the housing upper part, for example by locking teeth 27, 28, 29 which engage with a corresponding opening 31, 32, 33 formed, in each case, in the plate or wall 26.

Figure 3:
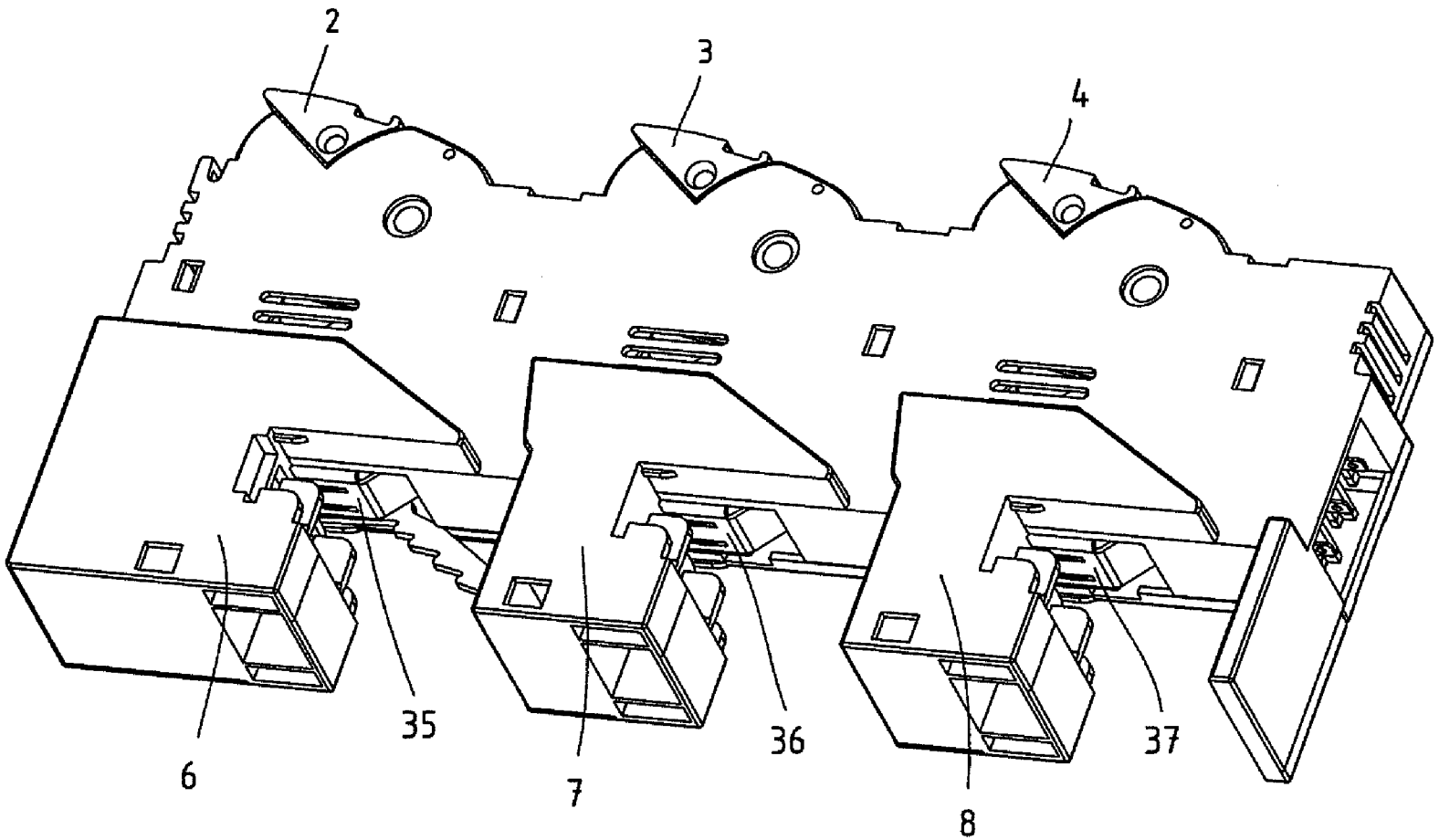
FIG. 3 is a perspective view from below of the fuse strip corresponding to FIG. 1.

FIG. 3 is a view from below of the fuse strip corresponding to the illustration shown in FIG. 1 and displays contact elements 35, 36, 37 which are inserted, above the clamping feet 6, 7, 8, into the housing in order to establish an electrical contact with the current rails once the fuse strip has been attached to the respective conductor rails.

The foregoing description discloses the formation, on the underside of the housing 1, of contact elements 35, 36, 37 above the clamping feet 6, 7, 8 in order to contact the conductor rails. The contact elements 35, 36, 37 are connected via a contact path to one end of the fuse elements inserted into the housing 1, whereas the other side of the fuse elements is guided via a contact path to a contact arrangement located inside the lateral terminal blocks 10, 11, 12, as will be described in greater detail hereinafter.

Figure 4:
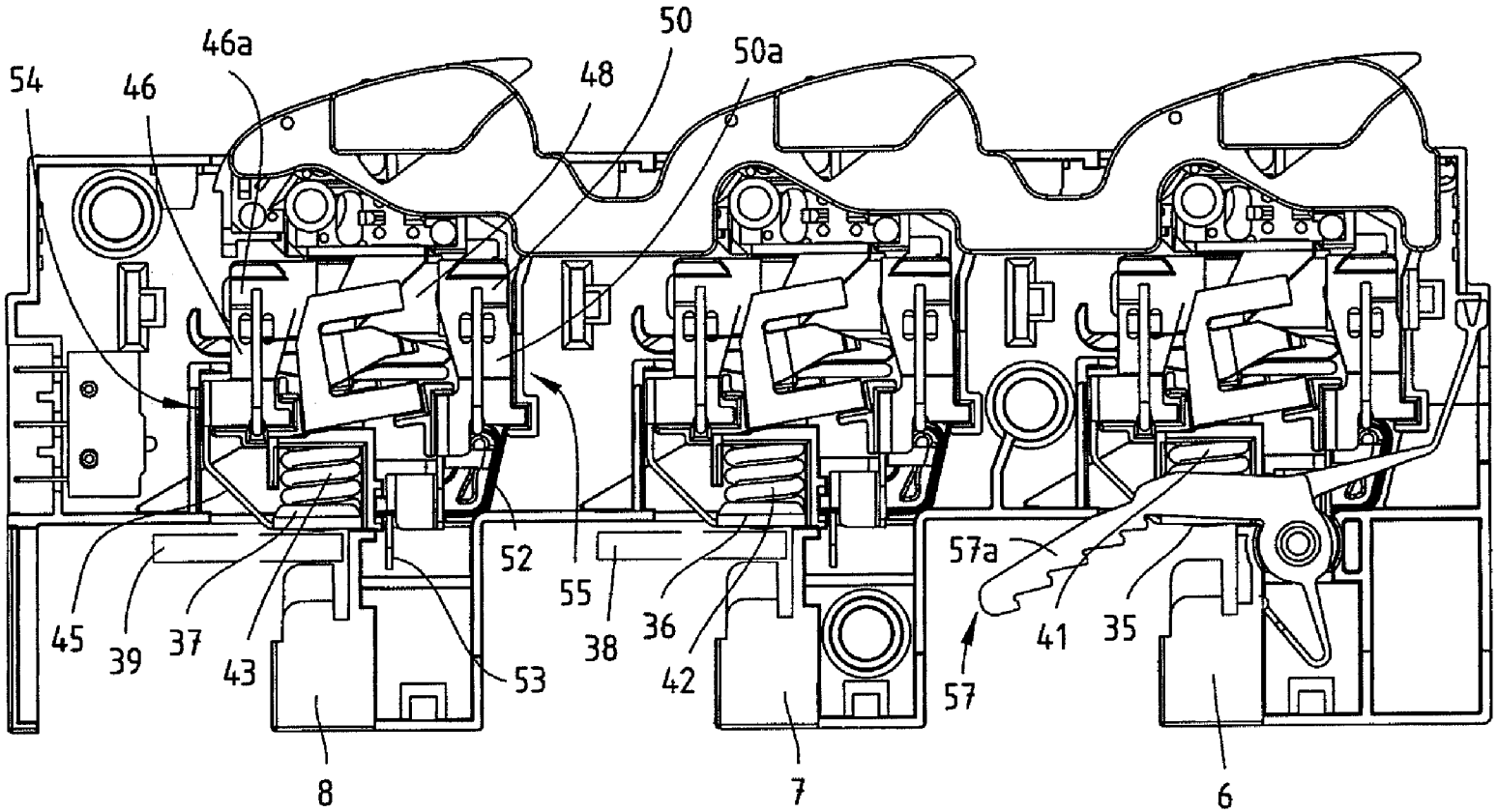
FIG. 4 is a view of the fuse strip corresponding to FIG. 2, the side walls having been removed to show the contact guide.

FIG. 4 is a side view of the fuse strip corresponding to FIG. 2, the wall or plate 26 having been removed to reveal the contact guide within the housing 1. In the three-pole fuse strip shown in FIG. 4, two of the three conductor rails are indicated by reference numerals 38, 39. The contact elements 35, 36, 37 are biased by springs 41, 42, 43 toward the respective conductor rails 38, 39 so as to ensure effective electrical contact between the contact elements 35 to 37 and the associated conductor rails 38, 39. With regard to the contact element 37, the circuit extends from the contact element 37, via a contact portion 45, to a contact 46 consisting of two contact tongues **46*a* extending substantially parallel and mirror-symmetrically to each other, as will be described hereinafter in greater detail. The contact tongues 46*a* encompass an end of a fuse element 48 provided, for example, with a cylindrical, conductive element, causing one side of the fuse element 48 or a safety fuse to be electrically contacted. The other end of the fuse or the fuse element 48 also has, for example, a cylindrically shaped conductor portion which is electrically connected to a further contact 50, the contact 50, like the contact 46, having two contact tongues 50*a* which extend substantially mirror-symmetrically to each other and contact the conductive end of the fuse element 48. From the contact 50, the circuit passes to the laterally arranged outgoing contact 53 via a contact portion 52**.

Details of the reception of the fuse elements 48 will not be described in greater detail, as they are not part of the subject-matter of the present invention.

FIG. 4 shows that the contacts 46, 48 can easily be inserted or introduced into the housing from the side which can be seen in FIG. 4. The contacts 46, 50 will be described hereinafter in greater detail. For receiving the contacts 46, 48, the housing contains corresponding recesses which ensure that the contacts can be inserted rapidly and reliably from the side into these recesses and/or ribs or projections and remain in the housing with no risk of slippage. Once the contacts 46, 50 have been introduced, the side of the housing shown open in FIG. 4 is closed by the cover or plate 26, the plate engaging with the housing in the described manner or being otherwise fastened. With regard to the contact tongues **46*a*, 50*a*, the contacts 46, 50** are basically and preferably of identical construction.

The foregoing description discloses that the recesses 54 and 55 for receiving the contacts 46, 50 preferably correspond substantially to the shape of the contacts 46, 50 in order to receive these contacts reliably and immovably. The housing can contain corresponding guide slots or recesses for the contact portions 42, 52. The contact portions 45, 52 are of differing construction. This will be described hereinafter in greater detail with reference to the portion 52. The portion 45 is, on the other hand, merely a portion for connecting to the contact 37.

Parts identical to those in FIG. 1 to 3 are provided in FIG. 4 with identical reference numerals and will not be described again.

In order reliably to position and to hold the fuse strip shown in FIG. 1 to 4 relative to the associated conductor rails 38, 39, there is provided, on the clamping foot 6 shown on the right-hand side in FIG. 4, a biased locking catch 57 which preferably has a lever **57*a*, which is provided with locking teeth and is biased by the biasing of the spring, in order, on the one hand, to allow the fuse strip to be used on conductor rails of differing design and, on the other hand, to ensure engagement with the respective conductor rail (not shown in FIG. 4**) once the fuse strip has been attached.

Figure 5:
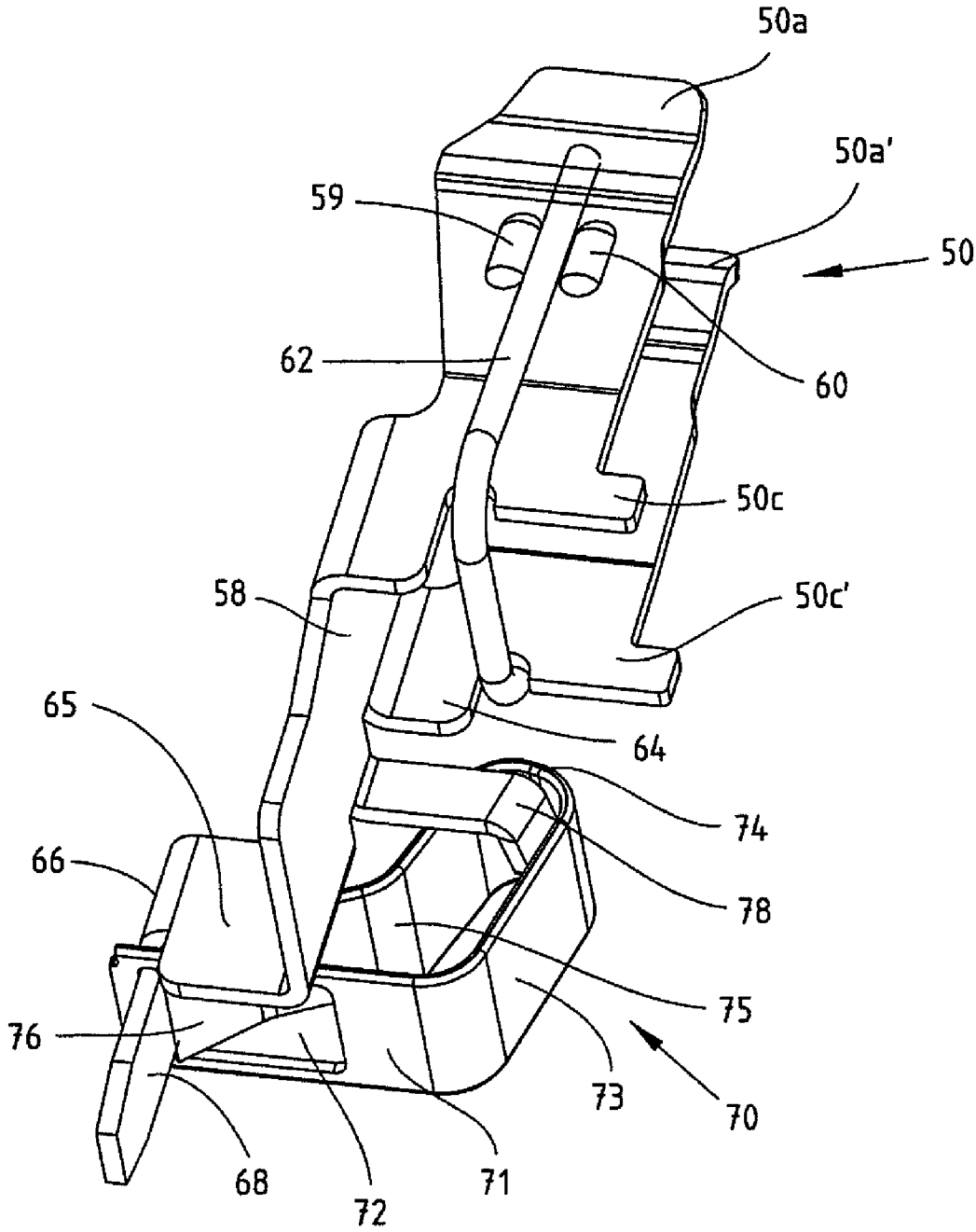
FIG. 5 is a perspective view to show the outgoing contact together with the associated contact element.

FIG. 5 is a perspective view of a contact 50 such as is preferably used in the embodiment shown in FIG. 4. Obviously, a contact 50 of this type is provided for each pole and the circuits, as described hereinbefore in conjunction with FIG. 4 with regard to the conductor rail 39, are defined for each pole. The same also applies to the remaining circuits or the conductor rail 38 with the contact element 36 above the clamping foot 7 and the conductor rail 39 with the contact element 35 above the clamping foot 6.

The contact 50 shown in FIG. 5 preferably consists of two contact tongues 50*a*, 50*a*' located substantially mirror-symmetrically to each other. These contact tongues 50*a*, 50*a*' encompass the conductive end of the fuse 48. At a portion denoted by 50*c*, 50*c*', the two contact tongues 50*a*, 50*a*' are connected to each other rigidly and preferably resiliently by a transverse clip 58.

In a preferred embodiment, both contact tongues 50*a*, 50*a*' have, in each case on their outside, two mutually parallel locking cams 59, 60 provided to fix a U-shaped spring 62 encompassing the two contact tongues 50*a*, 50*a*'. In this preferably used contact 50 shown in FIG. 5, the contact tongue 50*a*', in the form of a web 64 which is narrower than the wall 50*c*, is extended downwardly via the transverse clip 58 and forms, together with a portion 65 pointing laterally away from the web 64, an approximately L-shaped extension. The portion 65 is provided with a further portion 66 angled by 90°, the 90° angle being defined between the portions 65 and 66 in a direction so that the portion 66 protrudes outwardly from the plane of the tongue 50*a*', i.e. in a direction opposing the tongue 50*a* (FIG. 5). An extension 68, which is narrower than the portion 66, protrudes downwardly from the portion 66, as can easily be seen from FIG. 5. A spring 70 is preferably provided as a part additional to the contact 50, wherein the spring 70 can alternatively also be configured as a part integrated into the contact 50.

In the embodiment shown, the spring 70 is provided separately from the contact 50 so that an arm 71 of the spring 70 is provided with a slot or a substantially rectangular opening 72. The arm 71 protrudes from a base 73 of the spring 70 at an angle of approximately 90°, preferably greater than 90°. Provided on the base 73, after a substantially U-shaped transition portion 74, is a further arm 75 which, as shown in FIG. 5, has a slightly V-shaped curvature and carries at its end a spring tongue 76 which is slightly narrower than the slot 72 and abuts the contact portion 68 so as to be pivotable away therefrom.

The contact 50 comprising the spring 70 is configured in such a way that a stripped cable end, i.e. an outgoing line in FIG. 5, can be downwardly introduced, the spring tongue 76 pivoting in FIG. 5 in the anti-clockwise direction between the portion 68 and the spring tongue 76, i.e. screwless connection of the outgoing line is possible. Once the outgoing line has been introduced into the region between the portion 68 and spring tongue 76, the action of the spring tongue 76, which abuts the outgoing line (not shown) obliquely relative to the axis of the outgoing line, prevents the outgoing line from being retracted from this engagement. In order to allow the outgoing line to be removed from this engagement, release of the clamped outgoing line is possible, using a tool, preferably a screwdriver, which is introduced into the terminal block 10, 11 or 12 through the slotted opening 22 in FIG. 1, in that the screwdriver exerts pressure onto the arm 25 as a result of the end of the screwdriver acting either on the spring tongue 26 or on the approximately V-shaped portion of the arm 75 and thus brings about displacement of the spring tongue 76, in the clockwise direction in FIG. 5, for releasing the outgoing line.

As may be seen, the outgoing contacts, formed by the portions 65, 66, 75, 76, 78, are located in each of the terminal blocks 10, 11, 12, whereas the contact 50, provided for each pole, is inserted, within the housing 1 in FIG. 1, laterally of a fuse element and extends therefrom downward into the housing 1. The contact 50 is accordingly located above each outgoing contact. The contact 50 described with reference to FIG. 5 and the spring 70, i.e. the contact arrangement formed from the portions 50 and 70, ensure that the component 50 in electrical contact with each fuse is arranged approximately centrally within the upper housing part of the fuse strip, whereas the portion in the form of the spring 70 is offset, along with the portions 65, 66, 68, laterally outwardly relative to the contact 50, allowing the associated outgoing line to be inserted, laterally offset relative to the contact 50, into the outgoing contact in the form of the portions 65, 66, 68, 76. The outgoing contact itself, formed by the portions 65, 66, 68, 73, 74, 76, is therefore located in a plane located parallel and laterally outwardly offset relative to the plane of each fuse. As a result of this construction, the outgoing contact is arranged so as to be offset laterally into the terminal blocks 10, 11, 12, i.e. outwardly relative to the housing 1. The lateral formation of the guides 18, 19, 20 relative to the outgoing contacts comprising the clamping spring 70 is, in accordance with the invention, facilitated in that the spring contact 70 is provided so as to be laterally outwardly offset relative to the contact 50 located in the housing 1 or in the upper part of the housing.

As may also be seen from FIG. 5, there is provided on the L-shaped portion 64, 65, in the illustrated preferred embodiment of a contact 50, a curved lug 78 which protrudes from the face of the portions 64, 65 toward the plane in which the spring 70 is provided. In the illustrated embodiment, the lug 78 preferably extends in the shape of an S and acts as a stop or a limit for the base 73. After assembly, the entire contact 50, including the spring 70, is inserted from the side, in the manner shown in FIG. 5, into the recesses provided in the housing 1, for each pole provided.

The contact 50 and the spring 70 are made of metal or a conductive material, whereas the housing itself is made entirely or at least partially of plastics material, i.e. an insulating material.

The use of the contact arrangements, described as being preferable in conjunction with FIG. 5, thus allows direct connection of the outgoing lines immediately adjacently to the fuse elements provided within the housing 1, so, in the case of fuse strips of this type, conventional wires or the integration of contact paths from the respective fuse socket up to a predefined end face of the strip are dispensed with. The fuse strips can thus be of very narrow and compact construction, at least in the upper region of the housing 1. The laterally integrally formed terminal blocks 10, 11, 12 receiving the outgoing contacts ensure highly effective insulation and also prevent creepage currents between the individual adjacent outgoing contacts owing to the mutual separation of the individual terminal blocks 10, 11, 12 in the longitudinal or axial direction of the strip. The height of the terminal blocks 10, 11, 12 is chosen in such a way that the inlet openings in the guides 18, 19, 20 are located at a predetermined distance from the upper side of the housing 1, thus allowing outgoing lines also to be laid parallel and in the axial direction relative to the upper side of the housing 1 without the outgoing lines thereby in any way restricting the handling of the levers 2, 3, 4.

A preferred embodiment provides for the housing 1 to consist of a housing upper part and a housing lower part, the housing upper part being intended to be the portion denoted in FIG. 2 by reference numeral 1*a*, into which portion the individual contact arrangements can be introduced, whereas the plate 26 is to be understood as the housing upper part.

For assembling the contact arrangements, the housing lower part 1*a*, rotated backward through 90° compared to FIG. 2, is placed onto an assembly face, after which the individual contact arrangements, including the levers 2, 3, 4, are introduced before the plate or wall 26 is attached, as the housing upper part, and the contact arrangements are rigidly connected to the housing lower part 1*a* by the described locking means 27, 31 or joined together in a different manner.

In a further embodiment, the end face of the housing 1 is closed by a cover 80.

Figure 6:
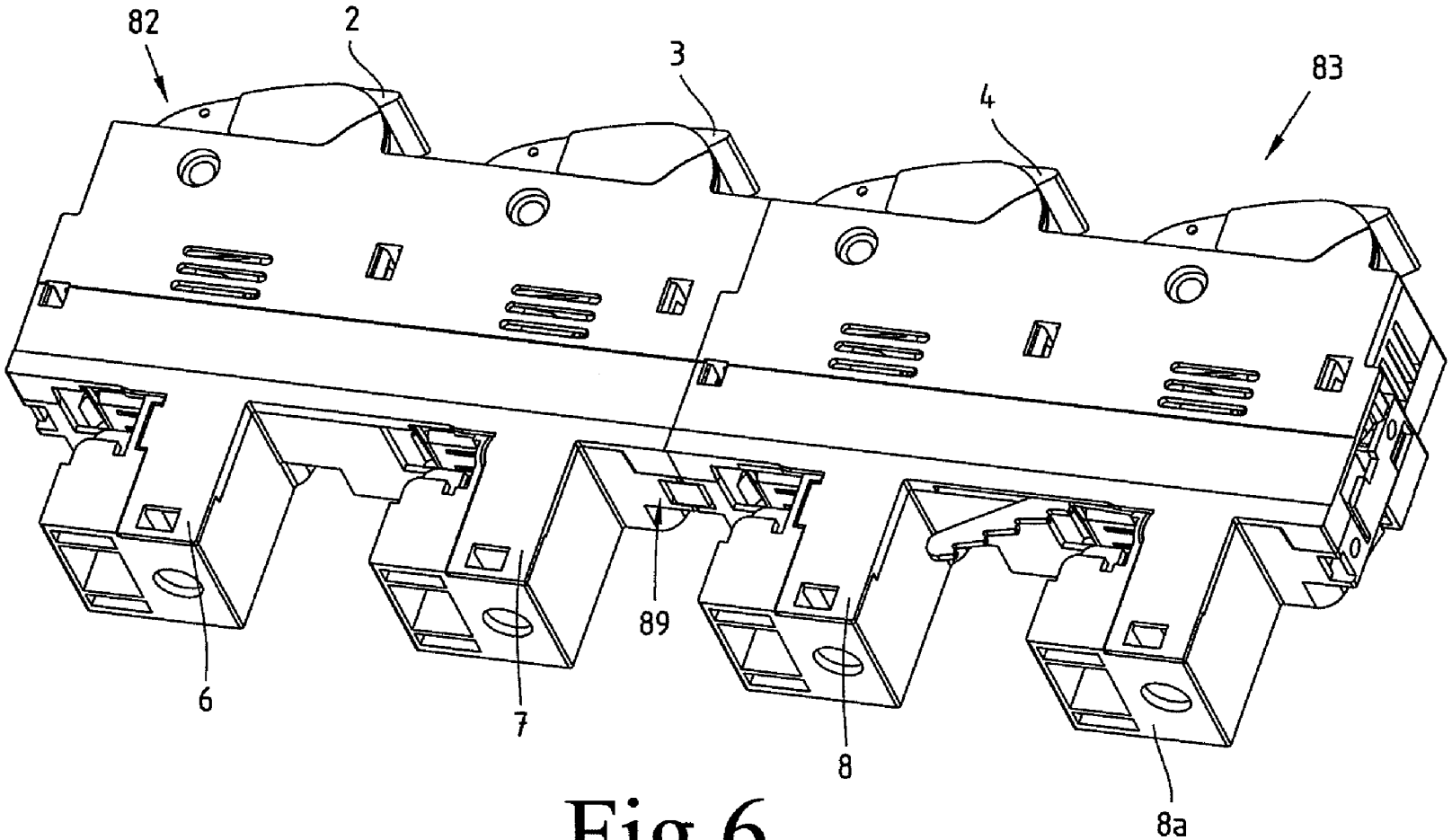
FIG. 6 is a schematic view of two two-pole fuse strips.

FIG. 6 shows two two-pole fuse strips having a construction as described basically with reference to FIG. 1 to 5. Identical parts are provided with the same reference numerals as in FIG. 1 to 5.

As shown in FIG. 6, two two-pole fuse strips are securely coupled, wherein the connection can, for example, be provided using a dovetail guide 89 or the like. The two two-pole fuse strips shown in FIG. 6 are, in any case, of identical construction, i.e. there is provided a fuse strip 82 and a further fuse strip 83 which are of identical construction and can, if necessary, be combined to form a four-pole fuse strip, the separating distance being in each case identical in a four-pole fuse strip of this type, i.e. the distance between the clamping foot 6 and clamping foot 7 corresponds to the distance between the clamping foot 7 and clamping foot 8. The terminal blocks (not shown in FIG. 6), located on the remote side, for the outgoing contacts are accordingly provided at a uniform distance from one another.

The basic advantage of the fuse strip described in conjunction with FIG. 6 is therefore that fuse strips, which can be two-pole or four-pole as desired, can be composed of identical elements, thus allowing the outgoing lines to be connected without screws by inserting the outgoing lines into the outgoing contacts of the terminal blocks. The fuse strips as a whole can thus be assembled very rapidly in conjunction with the associated switching devices.

Figure 8:
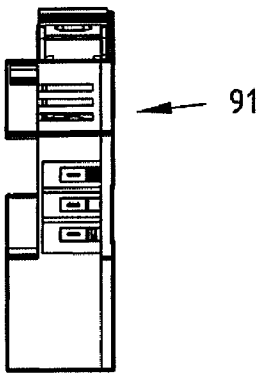
FIG. 8 is a view of the end face of the fuse strip, viewed from the direction of arrow A in FIG. 7.
Figure 7:
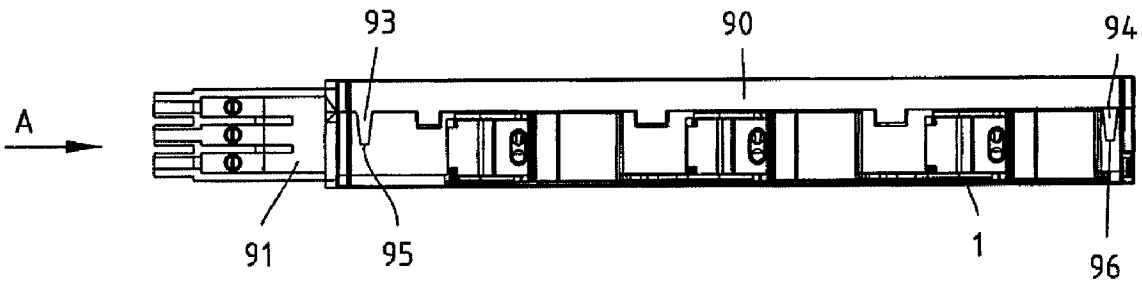
FIG. 7 illustrates a preferred embodiment of a fuse strip having substantially the structure described with reference to FIG. 1 to 5.

FIG. 7 is a plan view of a further embodiment of the invention based on the fuse strip as described in conjunction with FIG. 1 to 5. In this embodiment, as described hereinbefore, there are provided lateral terminal blocks 10, 11, 12 which are used, in the embodiment according to FIG. 1 to 5, to introduce outgoing lines, preferably without screws, into the associated outgoing contacts using clamping springs. The embodiment according to FIG. 7 to 9 seeks to modify the fuse strip so as to allow end-face terminal clamps to be utilised, if necessary, using the same fuse strip. For this purpose, the present invention provides for the lateral terminal blocks to be contacted by an adapter strip 90, the adapter strip 90 having at one end a module 91 for terminal screws or the like. FIG. 7 shows the fuse strip shown in FIG. 1 to 5 with an additional, laterally attached adapter strip 90 and the module 91, provided on the end face of the fuse strip, for terminal screws.

The adapter strip 90 has a width transversely to the longitudinal axis corresponding to the width of the terminal blocks 10, 11, 12, also viewed transversely to the longitudinal axis. Guide members 93, 94, which engage on the side of the housing with corresponding counter-guides 95, 96, are used for fastening the adapter strip 90.

Figure 9:
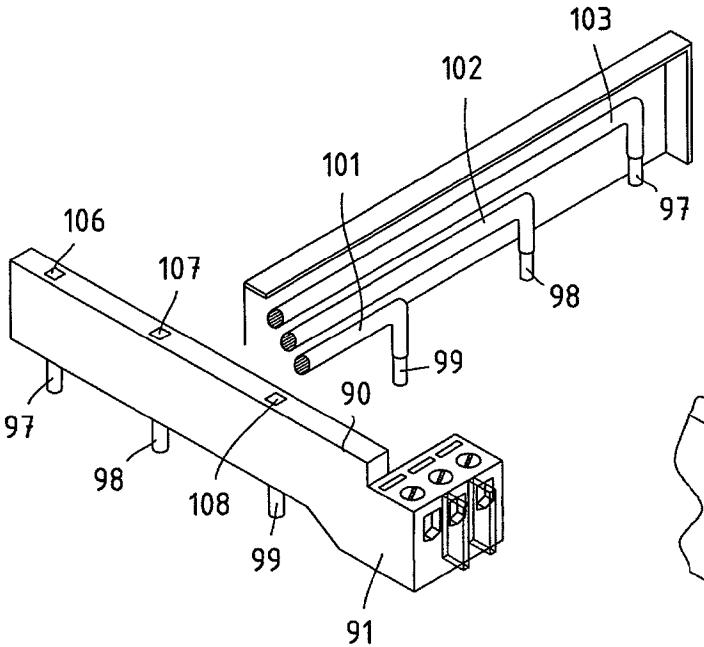
FIG. 9 is a perspective view of an adapter strip.

As may be seen from the schematic view of FIG. 9, each adapter strip 90 is equipped with terminal pins 97, 98, 99 which protrude, in each case, downwardly from the adapter strip 90 and are used to be inserted into the guides 18, 19, 20 of the terminal blocks in order to establish an electrical connection with the outgoing clamps of the fuse strip. As shown in FIG. 9, the module 91 is integrated into one end of the adapter strip 90, so as to protrude substantially perpendicularly laterally therefrom. The adapter strip 90 can, in various ways, have connection conductors 101, 102, 103 which are guided from the terminal pins 97, 98, 99 in the direction toward the terminal module 91.

Figure 10:
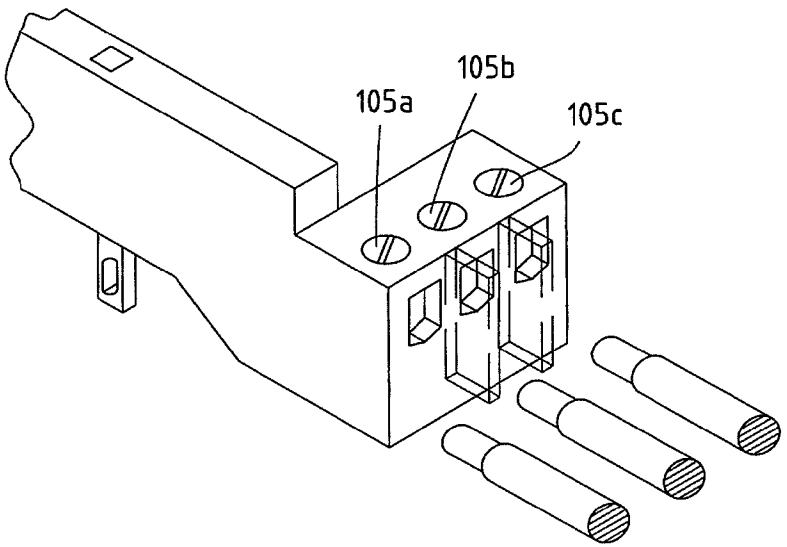
FIG. 10 is a side view of a preferred embodiment of the adapter strip according to FIG. 9.

FIG. 10 shows an example as to how these connection portions 101, 102, 103 can be configured. The adapter strip 90 is preferably equipped, as shown in FIG. 10, with integrated conductor tracks which are secured in the adapter strip 90 or are in the form, for example, of a printed circuit with terminal pins 97, 98, 99, so the conductor tracks 101, 102, 103 are integrated into a circuit board or the like and the end face of the circuit board is mechanically and electrically connected to the terminal module 91.

The terminal screws 105*a, b, c* of the terminal module 91 are of the conventional type and therefore do not need to be described in detail.

The adapter part 90 according to the invention thus allows the fuse strip shown in FIG. 1 to 5 to be converted in such a way that the terminal contacts are laid from the side toward the end face.

According to a further embodiment of the invention, each adapter strip is provided with slots 106, 107, 108 which are slightly vertically offset relative to the terminal pins 97 to 99 and are guided past the conductors or connections 101, 102, 103 in order to release an adapter strip 90, once attached, from the fuse strip or the terminal blocks, as described in conjunction with the actuating slots 22, 23, 24 (FIG. 1). In this embodiment, the slots 106, 107, 108 have to be aligned with the slots 22, 23, 24 in order to allow access to the spring tongue 76 or the actuating region 75 using a tool.

Figure 11:
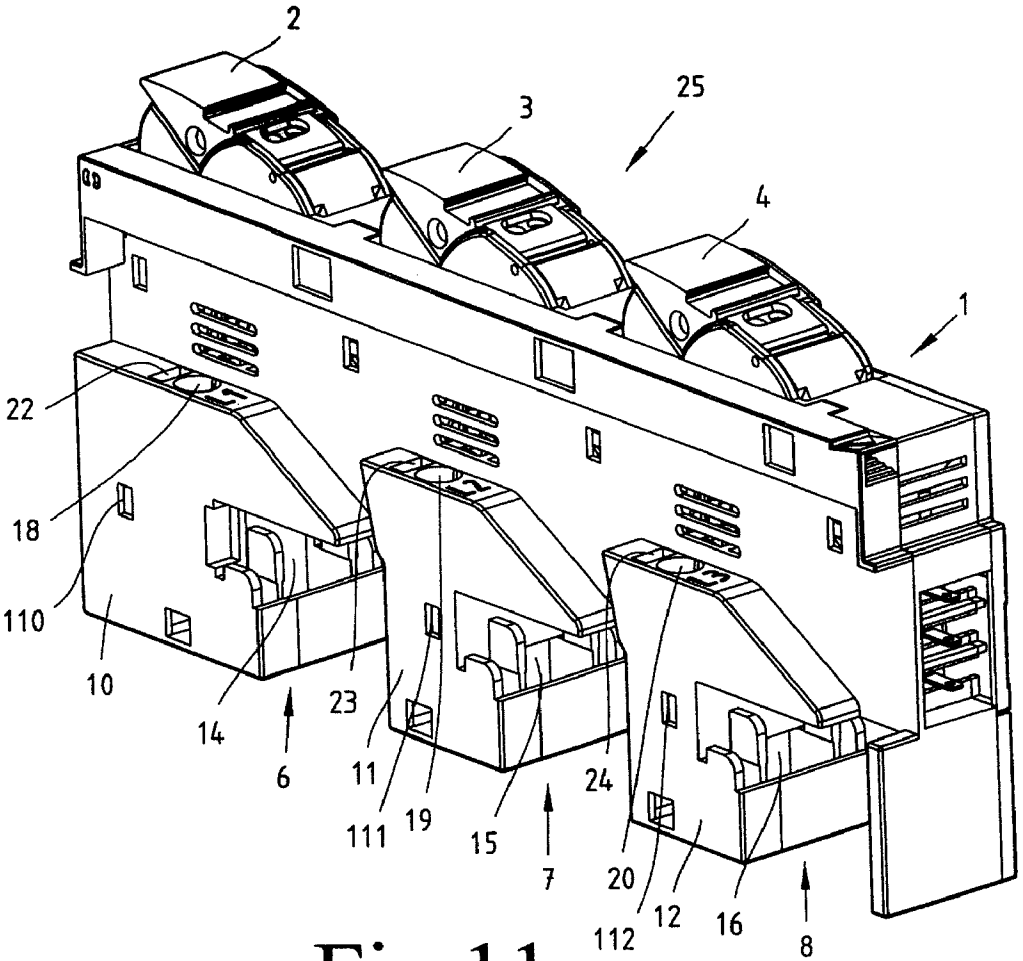
FIG. 11 shows an embodiment modified compared to FIG. 1.

Alternatively thereto, the slots 106, 107, 108 can be replaced by slots 110, 111, 112 formed laterally in the wall of each terminal block 10, 11, 12. If this end is introduced, using a tool, for example a screwdriver, into one of the slots 110, 111, 112 (FIG. 11), the clamping action between the respective contact pins 97, 99 can be cancelled, thus allowing the module 90 to be raised, by pivoting the spring tongue 76 (FIG. 9) in the clockwise direction using a screwdriver or the like, and releasing the associated contact pin.

What is claimed is:

1. A fuse strip comprising:

at least two poles;

a housing;

at least two fuse contactors arranged in the housing, each configured to receive respective fuse elements;

at least two clamping feet provided on an underside of the housing, wherein a contact element is configured to engage a conductor rail in a region of each clamping foot of said at least two clamping feet;

at least two terminal blocks, each terminal block of said at least two terminal blocks provided laterally of the housing in the region of each clamping foot for each pole of said at least two poles;

at least two outgoing contacts, each outgoing contact of said at least two outgoing contacts arranged in a respective terminal block of said at least two terminal blocks, each said outgoing contact configured to be connected with a respective outgoing line, wherein each said outgoing contact includes a contact and a clamping spring, the clamping spring having a spring tongue biased against an extension of the contact.

2. The fuse strip according to claim 1, wherein each terminal block comprises a guide for the introduction of outgoing lines.

3. The fuse strip according to claim 2, wherein said guide is configured perpendicularly to the longitudinal axis of the fuse strip.

4. The fuse strip according to claim 1, wherein each contact has an extended contact portion on which there is formed a portion which points away from the contact and further has a contact tongue for receiving said clamping spring.

5. The fuse strip according to claim 1, wherein the clamping spring is provided laterally offset to the contact.

6. Fuse strip according to claim 1, wherein the clamping spring is a part separate from the contact and has an arm comprising a slot in such a way that the contact spring tongue of the clamping spring is arranged adjustably within the slot and the slot receives the extension of the contact.

7. The fuse strip according to claim 1, wherein each contact has two contact tongues located parallel and mirror-symmetrically to each other.

8. Fuse strip according to claim 1, wherein each terminal block contains a guide for receiving a contact pin of an adapter strip in such a way that when the adapter strip is attached, each contact spring pin is electrically connected to the associated outgoing contact of each terminal block, and in that the adapter strip is provided with an end-face module comprising terminal clamps.

9. Fuse strip according to claim 8, wherein the adapter strip contains electrical conductors which establish a connection between the contact pins, on the one hand, and the terminal clamps of the end-face module, on the other hand.

10. Fuse strip according to claim 8, wherein the adapter strip is provided with through-openings which are aligned with corresponding terminal block openings when the adapter strip is attached to the housing.

11. Fuse strip according to claim 1, wherein the terminal blocks have lateral openings allowing access to each clamping spring tongue of the clamping spring.

12. The fuse strip according to either claim 1, wherein each terminal block further comprises an opening for the introduction of a tool toward the outgoing contact for clearing the outgoing line.

* * * * *